US006578509B1

(12) United States Patent
Brushaber

(10) Patent No.: US 6,578,509 B1
(45) Date of Patent: Jun. 17, 2003

(54) MOORING WHIP MOUNTING BASE FOR SELECTIVE MOVEMENT OF MOORING WHIP BETWEEN POSITIVE STOPS DETERMINING MOORING AND RETRACTED POSITIONS

(76) Inventor: Donald Brushaber, 221 Hayes Ct., Normandy Beach, NJ (US) 08739

( * ) Notice: Subject to any disclaimer, the term of this patent is extended or adjusted under 35 U.S.C. 154(b) by 0 days.

(21) Appl. No.: 10/236,152

(22) Filed: Sep. 6, 2002

(51) Int. Cl.[7] ..... B63D 21/00
(52) U.S. Cl. ..... 114/230.11; 248/514
(58) Field of Search ..... 114/230.11, 230.15, 114/230.19; 248/514, 517, 520, 538

(56) References Cited

U.S. PATENT DOCUMENTS

| | | | | | |
|---|---|---|---|---|---|
| 804,390 | A | * | 11/1905 | Duffy | 211/62 |
| 1,987,842 | A | * | 1/1935 | Sampson | 248/538 |
| 2,640,534 | A | | 6/1953 | Coffing | |
| 2,996,033 | A | | 8/1961 | Yordi | |
| 3,120,831 | A | | 2/1964 | Fulton | |
| 3,187,707 | A | | 6/1965 | Carbone | |
| 3,196,824 | A | | 7/1965 | Howard | |
| 3,786,778 | A | * | 1/1974 | Palmer et al. | 116/313 |
| 4,040,377 | A | * | 8/1977 | Olsen | 114/230.11 |
| 4,356,783 | A | | 11/1982 | Myklebust et al. | |
| 4,676,182 | A | * | 6/1987 | Chaiko | 114/230.25 |
| D306,396 | S | * | 3/1990 | Brushaber | D8/355 |
| 5,036,787 | A | | 8/1991 | Rogers | |
| 5,154,132 | A | * | 10/1992 | Brushaber | 114/230.11 |
| 5,243,926 | A | | 9/1993 | Wright et al. | |
| 6,032,604 | A | | 3/2000 | Will | |

* cited by examiner

*Primary Examiner*—Sherman Basinger
(74) *Attorney, Agent, or Firm*—Arthur Jacob

(57) ABSTRACT

A mooring whip mounting base has a basal member for affixation to a docking structure, a holding member for holding a mooring whip for mooring a boat adjacent the docking structure, and a connecting structure for selective movement of the holding member to selectively move the mooring whip between a mooring position, wherein the mooring whip extends at a relatively shallow angle to a horizontal direction, and a more nearly vertical retracted position, wherein the mooring whip is retracted to gain ready access to the boat for boarding and better clearance for departure of the boat from the dock. A positive stop arrangement includes positive stops for limiting movement of the holding member to movement between positive first and second positions so as to positively determine the mooring and retracted positions of the mooring whip while facilitating selective movement of the mooring whip between the mooring and retracted positions.

22 Claims, 4 Drawing Sheets

MOORING WHIP MOUNTING BASE FOR SELECTIVE MOVEMENT OF MOORING WHIP BETWEEN POSITIVE STOPS DETERMINING MOORING AND RETRACTED POSITIONS

The present invention relates generally to the mooring of small boats at docking structures and pertains, more specifically, to a mooring whip mounting base enabling selective movement of a mooring whip between a mooring position and a retracted position, with positive stops determining both the mooring position and the retracted position of the mooring whip.

Mooring whips have found widespread use in the mooring of boats where it is desired to secure a boat to a boat dock or another docking structure while maintaining the boat spaced away from the dock a relatively short distance so as to protect against marring or otherwise damaging the hull of the boat as a result of rubbing or bumping against the dock. In a typical mooring whip installation, a mooring whip is mounted on a boat dock, a mooring line is attached between a boat and the tip of the mooring whip, and the mooring whip is placed in a mooring position wherein the mooring whip is flexed into a bowed configuration to bias the boat away from the dock and thereby protect the hull of the boat against damage from rubbing or bumping against the dock.

When it is desired to bring the moored boat to the dock for boarding, the mooring line is released from the mooring whip, allowing the boat to be moved freely to the dock for boarding. The mooring whip itself is raised so as to move the mooring whip to a retracted position, allowing free access to the boat and facilitating subsequent departure of the boat from the dock. Ordinarily, the mooring whip is biased resiliently toward the retracted position by a biasing mechanism in the mounting base which mounts the mooring whip to the dock, and movement to the mooring position tends to bow the mooring whip and thus "load" the mooring whip with a force sufficient to maintain the boat moored at a safe distance from the dock. When released from the boat, the mooring whip is moved to and maintained in the retracted position by the biasing force of the resilient biasing mechanism.

The present invention provides a mooring whip mounting base which enables movement between a mooring position determined by a first positive stop and a retracted position determined by a second positive stop, the positive positions attaining improved performance without the use of a resilient biasing arrangement, and wherein positioning of the mooring whip in either the mooring position or the retracted position is facilitated. As such, the present invention attains several objects and advantages, some of which are summarized as follows: Facilitates and simplifies the selective placement and retention of a mooring whip in either a mooring position or a retracted position; places a mooring whip in a mooring position which enables a more effective biasing of a boat away from a dock, and in a retracted position which provides ready access to the boat for boarding and better makes way for departure of the boat from the dock; allows the use of a shorter mooring whip with increased strength positioned to provide biasing forces sufficient to perform effectively with larger boats, as well as with smaller boats; enables a positive placement of a mooring whip in a selectively adjustable mooring position or retracted position for optimum performance in a variety of installations; enhances the operation and simplifies the use of mooring whips in connection with a wider range of boats and docking structures; enables increased safety in the use of mooring whips, thereby promoting safer use of boats; allows better protection of a wider variety and range of sizes of boats moored at docking structures, together with increased ease of boarding and departure; provides a mooring whip base of simplified construction for economical manufacture and exemplary performance over an extended service life.

The above objects and advantages, as well as further objects and advantages, are attained by the present invention which may be described briefly as a mooring whip mounting base for mounting a mooring whip to a docking structure with the mooring whip moveable selectively between a mooring position, wherein the mooring whip extends outwardly from the docking structure to bias a moored boat away from the docking structure, and a retracted position, wherein the mooring whip extends upwardly and inwardly relative to the mooring position of the mooring whip, the mooring whip having a near end adjacent the docking structure and a far end spaced away from the docking structure, the mooring whip mounting base comprising: a basal member for affixation to the docking structure; a holding member for holding the mooring whip at the near end of the mooring whip; a connecting structure connecting the holding member with the basal member for selective movement of the holding member relative to the basal member between a first position wherein the mooring whip will extend outwardly from the docking structure at a mooring angle to a horizontal direction to be placed in the mooring position, and a second position wherein the mooring whip will extend upwardly at a retracted angle to a vertical direction to be placed in the retracted position; and a positive stop arrangement for limiting movement of the holding member to movement between the first position and the second position, the positive stop arrangement including a first positive stop for engagement upon movement of the holding member from the second position to the first position to preclude movement of the holding member beyond the first position, and a second positive stop for engagement upon movement of the holding member from the first position to the second position to preclude movement of the holding member beyond the second position.

The invention will be understood more fully, while still further objects and advantages will become apparent, in the following detailed description of a preferred embodiment of the invention illustrated in the accompanying drawing, in which.

Figure 1:
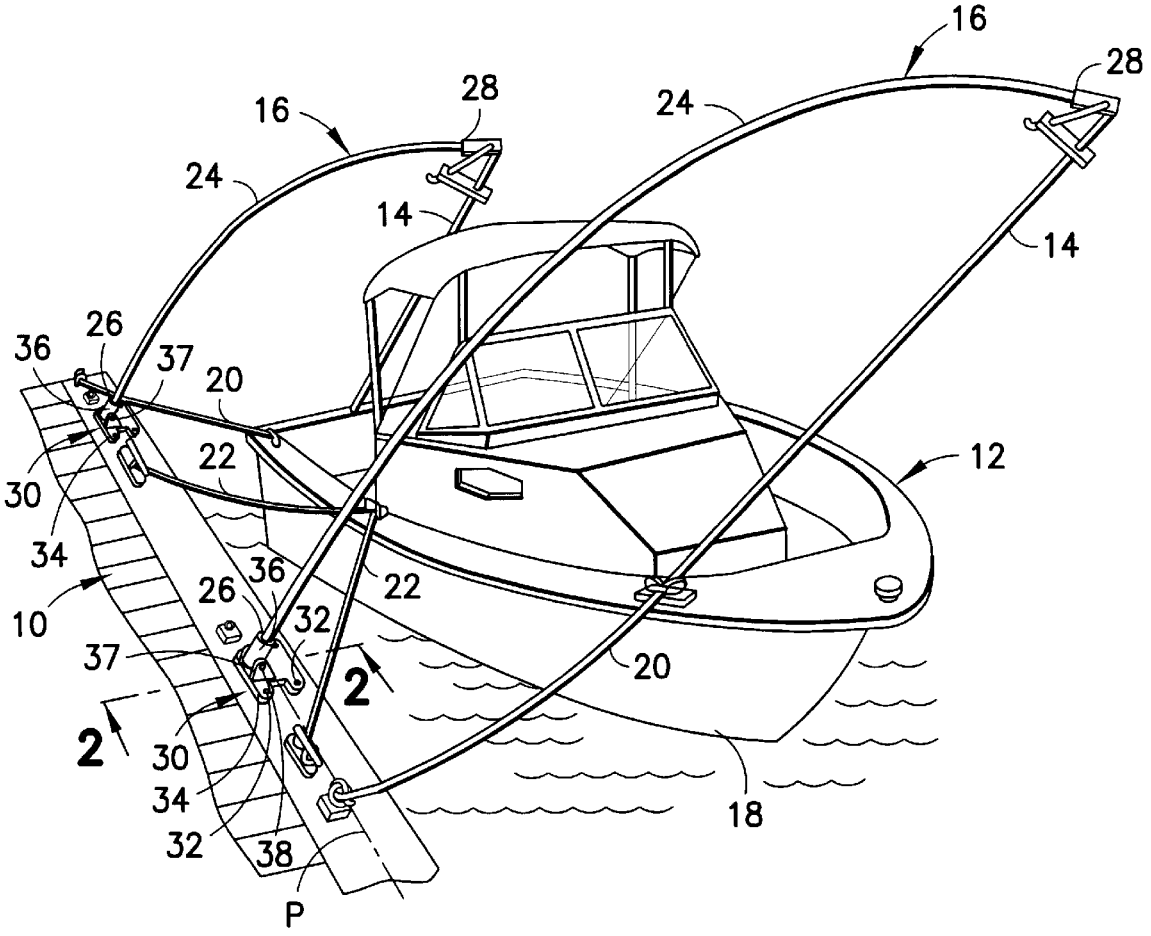
FIG. 1 is a pictorial view of a boat moored at a docking structure with mooring whips and utilizing mounting bases constructed in accordance with the present invention.

Referring now to the drawing, and especially to FIG. 1 thereof, a docking structure is shown in the form of a boat dock 10, and a boat 12 is moored through the use of a pair of mooring lines 14 attached to a corresponding pair of mooring whips 16. The mooring whips are flexed into a bowed configuration so that the mooring lines 14 pull outwardly away from the dock 10 and thereby preclude damage to the hull 18 of the boat 12, which otherwise could result from rubbing or bumping against the dock 10. Supplemental lines 20 and 22 assist in the proper mooring of the boat 12, all in a manner now well known in boat mooring techniques. Each mooring whip 16 includes a resiliently flexible pole 24, usually constructed of durable and weather-resistant material, such as a fiberglass reinforced polyester, extending between a near end 26 and a far end 28. Mooring lines 14 are attached to mooring whips 16 adjacent the far end 28 of each respective mooring whip 16.

A mounting base constructed in accordance with the present invention is shown at 30 and is affixed to the dock 10, as by bolts 32 which extend through a basal member 34 of the mounting base 30 and into the dock 10, for mounting each mooring whip 16 to the dock 10. A holding member is illustrated in the form of a socket component 36 coupled with the basal member 34, by means of a connecting structure shown in the form of ears 37 on the basal member 34 carrying a pivot pin 38 which couples the socket component 36 with the basal member 34 for essentially unbiased pivotal movement relative to the basal member 34 about a pivotal axis P extending generally parallel to the dock 10, and generally parallel to the fore-and-aft direction along the boat 12.

Figure 2:
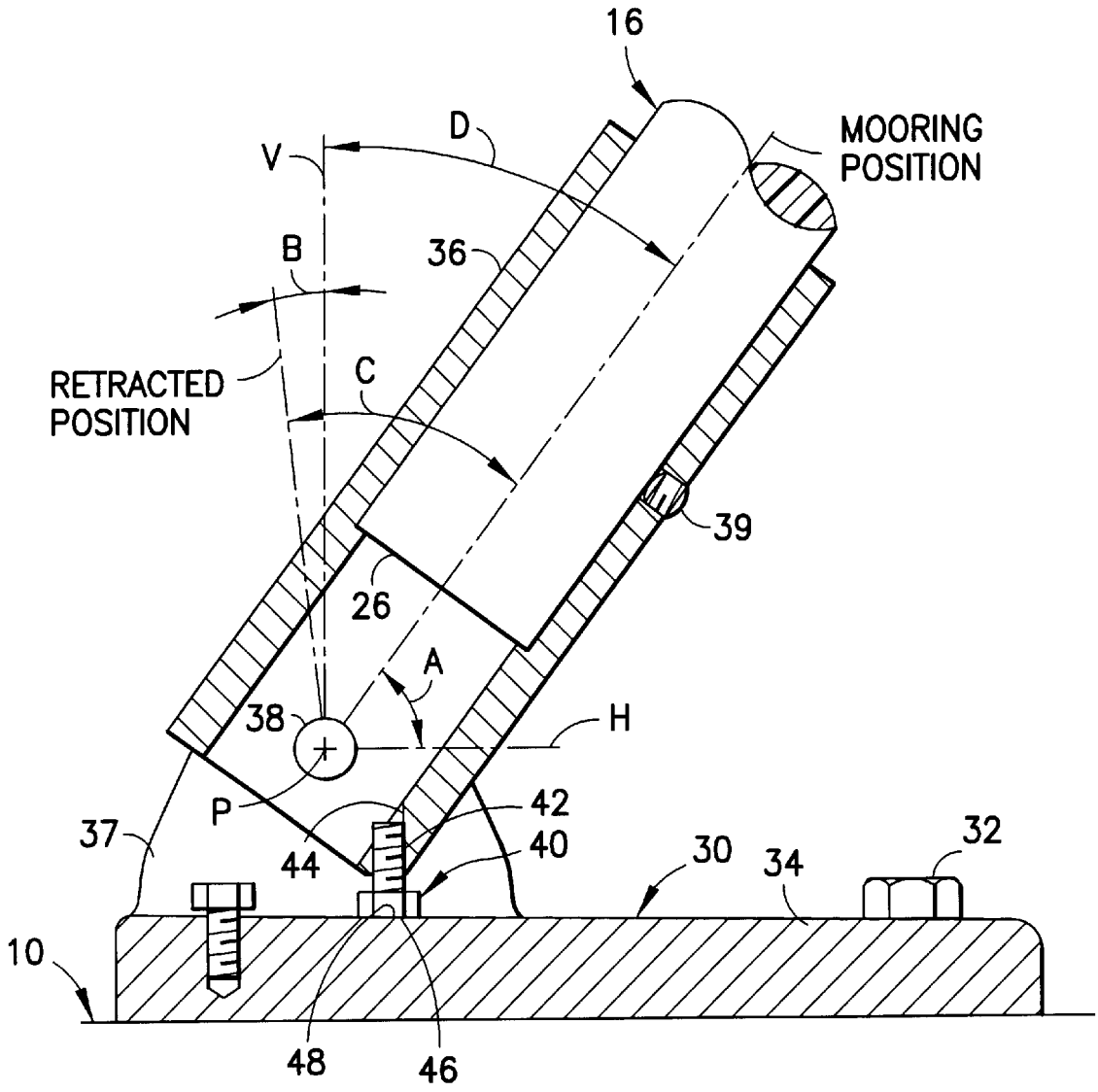
FIG. 2 is an enlarged fragmentary cross-sectional view taken along line 2—2 of FIG. 1.

As best seen in FIG. 2, as well as in FIG. 1, the near end 26 of a mooring whip 16 is received within the socket component 36 of a mounting base 30 and is secured therein with a set screw 39. Mooring whip 16 is illustrated in a mooring position wherein the mooring whip 16 extends outwardly from the dock 10 at a relatively shallow mooring angle, shown as angle A to horizontal direction H, and is bowed to bias boat 12 away from the dock 10, as described above. The mooring position of the mooring whip 16 is determined by a first position of the socket component 36, illustrated in FIGS. 1 and 2 and which, in turn, is determined by a first positive stop 40 of a positive stop arrangement. First positive stop 40 includes a first selectively adjustable stop element shown in the form of a threaded member 42 threaded preferably into socket component 36 at 44 and having a stop face 46 confronting the basal member 34 at 48. The threaded member 42 is selectively threaded in directions into and out of the socket component 36 to move the stop face 46 toward or away from the socket component 36 and thereby selectively adjust the position of the socket component 36 relative to the basal member 34 and, in turn, the mooring position of the mooring whip 16. In the mooring position, mooring whip 16 extends outwardly from the dock 10 at the relatively shallow angle A, preferably in the range of about 20° to about 30° to the horizontal direction H. The relatively shallow angle A enables the use of a shorter pole 24 in reaching out over even larger boats, while maintaining a more compact installation. Moreover, a shorter pole 24 operating at a shallower angle A provides a more renitent mooring whip 16 establishing an increased outward biasing force for better handling of a wider range of boats.

Figure 3:
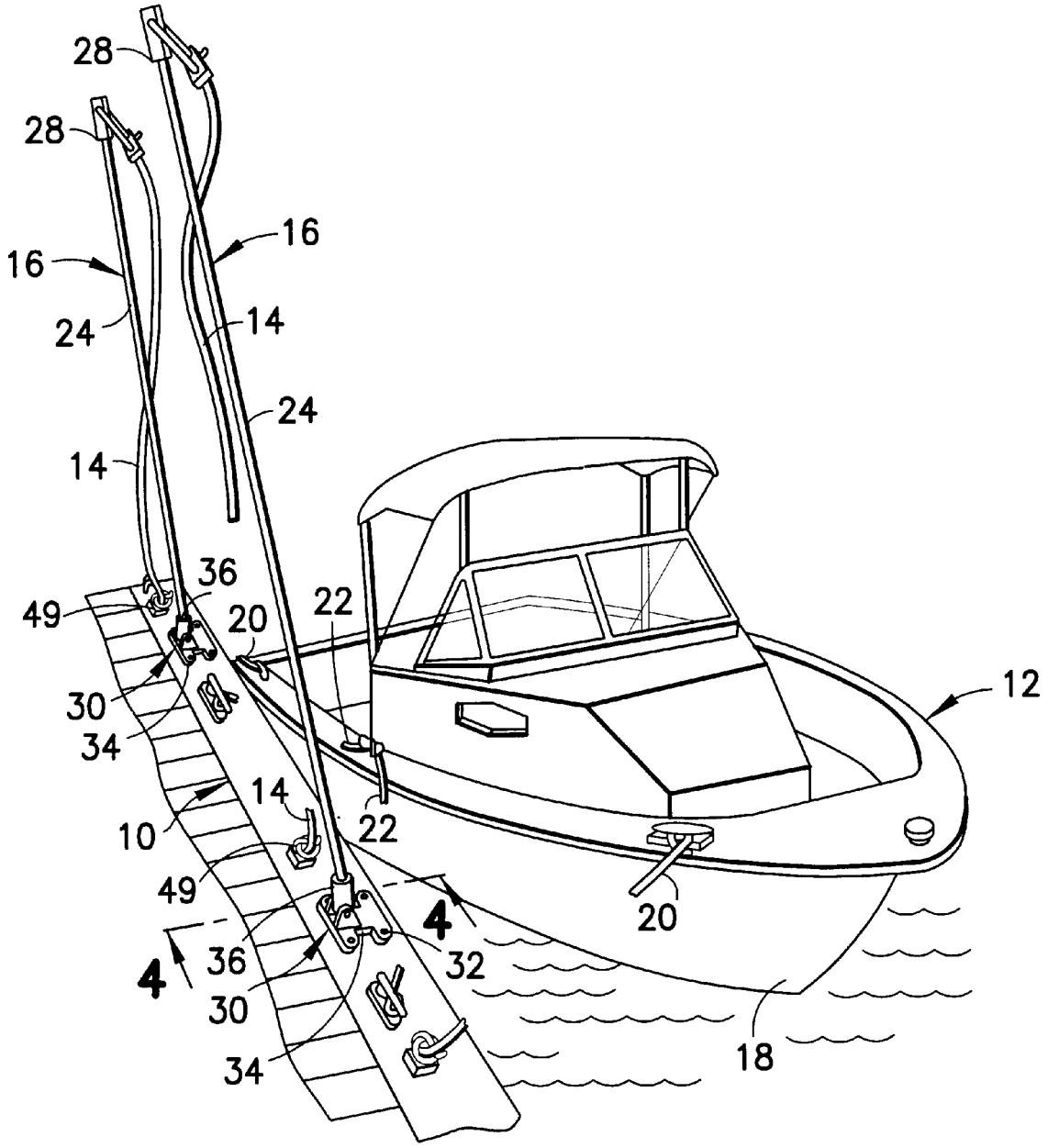
FIG. 3 is a pictorial view similar to FIG. 1 and showing the mooring whips, mounting bases and the boat in another position.
Figure 4:
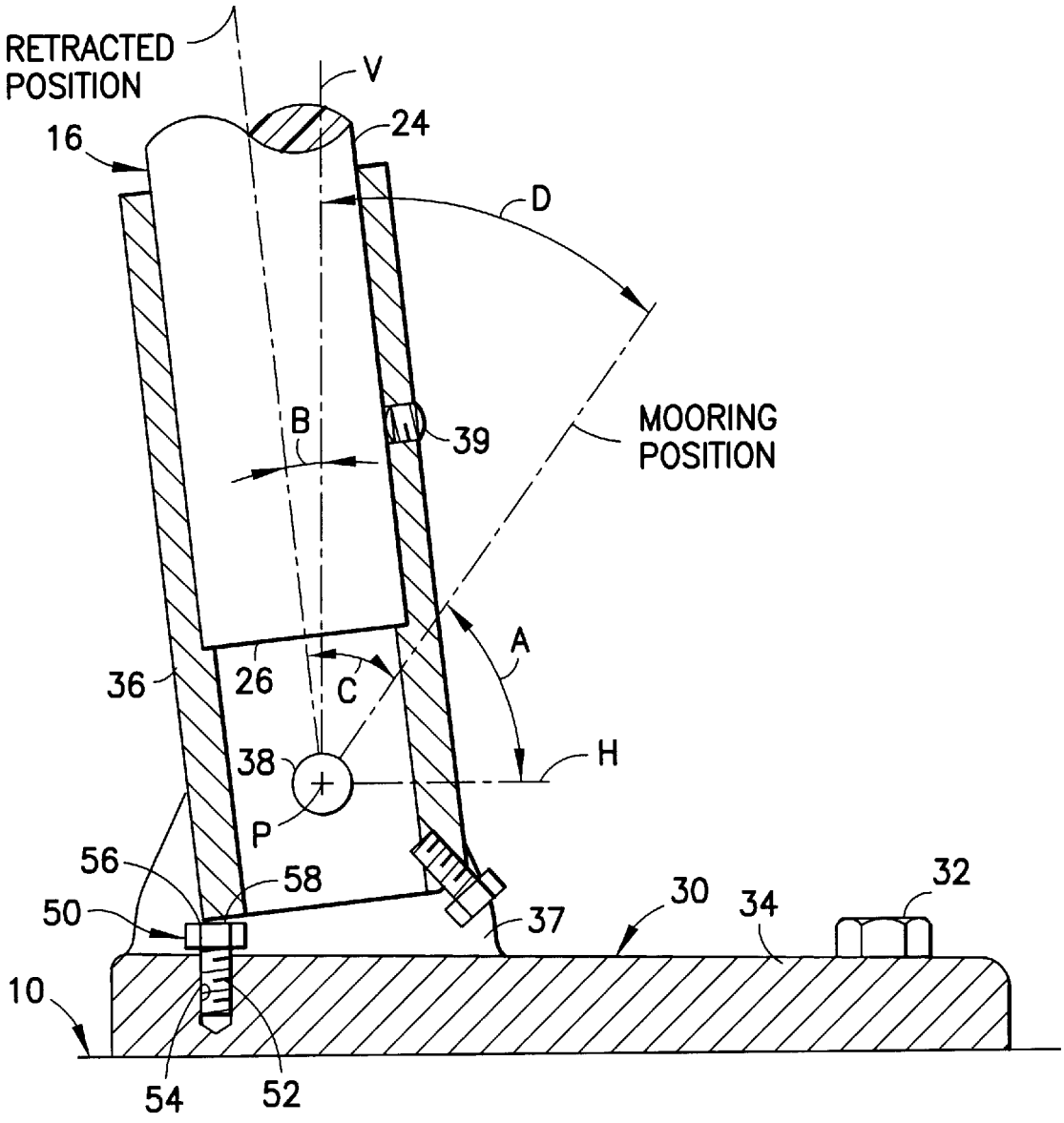
FIG. 4 is an enlarged fragmentary cross-sectional view taken along line 4—4 of FIG. 3.

When it is desired to board the boat 12, mooring lines 14 are released from the boat 12, the mooring whips 16 are moved to a retracted position, as illustrated in FIGS. 3 and 4, wherein the mooring whips 16 are raised to move the far end 28 of each mooring whip 16 upwardly and inwardly beyond a vertical direction V, the mooring lines 14 preferably are secured to the dock 10, as at 49, and the boat 12 is moved toward the dock 10 for boarding. The retracted position of each mooring whip 16 is determined by a second position of the socket component 36 which is determined by. a second positive stop 50 of the positive stop arrangement. Second positive stop 50 includes a second selectively adjustable stop element shown in the form of a threaded member 52 threaded preferably into basal member 34 at 54 and having a stop face 56 confronting the socket component 36 at 58. The threaded member 52 is selectively threaded in directions into and out of the basal member 34 to move the stop face 56 toward or away from the basal member 34 and thereby selectively adjust the position of the socket component 36 relative to the basal member 34 and, in turn, the retracted position of the mooring whip 16. In the retracted position, each mooring whip 16 extends upwardly and inwardly at a retracted angle, shown as angle B to the vertical direction V, angle B preferably being in the range of about 15° to about 20°. The inward angle B enables retention of the mooring whip 16 in the retracted position by gravity, while the more vertical orientation allows essentially unobstructed access to the boat 12 for easier boarding, and for clearing the way for departure of the boat 12 from the dock 10, the retracted position placing the mooring whip 16 back far enough to avoid interference with protruding structural features of the boat 12, such as any antennas, masts, outriggers and the like.

Thus, upon pivotal movement of the socket component 36 about pivotal axis P relative to the basal member 34 from the second position toward the first position of the socket component 36, engagement of the stop face 46 of the threaded member 42 precludes movement of the socket component 36 beyond the first position and positively determines the mooring position of the mooring whip 16. Upon pivotal movement of the socket component 36 from the first position toward the second position, engagement of the stop face 56 of the threaded member 52 precludes movement of the socket component 36 beyond the second position and positively determines the retracted position of the mooring whip 16. As indicated in the above description, the preferred range of motion of the socket component 36, between the first position and the second position, illustrated by angle C in FIGS. 2 and 4, is about 75° to about 90°, which is the total of about 60° to about 70° outward of the vertical direction V (angle D), and about 15° to about 20° inward of the vertical direction V (angle B). While exemplary performance has been observed where, as described above in the preferred arrangement, threaded member 42 is threaded into socket component 36 and threaded member 52 is threaded into basal member 34, it will be apparent that similar results can be attained by alternately threading threaded member 42 into basal member 34. Likewise, threaded member 52 alternately may be threaded into socket component 36.

The ability to positively set the mooring and retracted positions of the mooring whips 16 and to selectively move the mooring whips 16 into and out of the mooring and retracted positions with ease enables a better position of each mooring whip 16 and improved outward biasing of the boat 12 during mooring, so that the boat 12 is more effectively protected against damage when moored away from the dock 10, is readily accessed at the dock 10 for increased safety in boarding, and is better cleared for safe departure.

It will be seen that the present invention attains the several objects and advantages summarized above, namely: Facilitates and simplifies the selective placement and retention of a mooring whip in either a mooring position or a retracted position; places a mooring whip in a mooring position which enables a more effective biasing of a boat away from a dock, and in a retracted position which provides ready access to the boat for boarding and better makes way for departure of the boat from the dock; allows the use of a shorter mooring whip with increased strength positioned to provide biasing forces sufficient to perform effectively with larger boats, as well as with smaller boats; enables a positive placement of a mooring whip in a selectively adjustable mooring position or retracted position for optimum performance in a variety of installations; enhances the operation and simplifies the use of mooring whips in connection with a wider range of boats and docking structures; enables increased safety in the use of mooring whips, thereby promoting safer use of boats; allows better protection of a wider variety and range of sizes of boats moored at docking structures, together with increased ease of boarding and departure; provides a mooring whip base of simplified construction for economical manufacture and exemplary performance over an extended service life.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. An improvement in a mooring whip installation wherein a mooring whip is mounted to a docking structure by a mooring whip mounting base to bias a moored boat away from the docking structure with the mooring whip moveable selectively between a mooring position, wherein the mooring whip extends outwardly from the docking structure to bias a moored boat away from the docking structure, and a retracted position, wherein the mooring whip extends upwardly and inwardly relative to the mooring position of the mooring whip, the mooring whip having a near end adjacent the docking structure and a far end spaced away from the docking structure, the improvement comprising:

a basal member for affixation to the docking structure;

a holding member for holding the mooring whip at the near end of the mooring whip;

a connecting structure connecting the holding member with the basal member for essentially unbiased selective movement of the holding member relative to the basal member between a first position wherein the mooring whip will extend outwardly from the docking structure at a relatively shallow mooring angle to a horizontal direction to be placed in the mooring position, and a second position wherein the mooring whip will extend upwardly at a retracted angle to a vertical direction to be placed in the retracted position; and a positive stop arrangement for limiting movement of the holding member to movement between the first position and the second position, the positive stop arrangement including a first positive stop for engagement upon movement of the holding member from the second position to the first position to preclude movement of the holding member beyond the first position, and a second positive stop for engagement upon movement of the holding member from the first position to the second position to preclude movement of the holding member beyond the second position.

2. The invention of claim 1 wherein the retracted angle is inward of the vertical direction.

3. The invention of claim 2 wherein the connecting structure comprises a pivotal coupling enabling the essentially unbiased pivotal movement of the holding member between the first position and the second position.

4. The invention of claim 3 wherein the mooring angle is in a range of about 20° to about 30°.

5. The invention of claim 3 wherein the retracted angle is in a range of about 15° to about 20°.

6. The invention of claim 3 wherein the mooring angle is in a range of about 20° to about 30°, and the retracted angle is in a range of about 15° to about 20°.

7. The invention of claim 3 wherein the holding member includes a socket component for receiving the near end of the mooring whip.

8. The invention of claim 3 wherein the first positive stop includes a selectively adjustable stop element for selective adjustment of the first position of the holding member.

9. The invention of claim 3 wherein the second positive stop includes a selectively adjustable stop element for selective adjustment of the second position of the holding member.

10. The invention of claim 9 wherein the selectively adjustable stop element includes a threaded member threaded into the basal member and having a stop face for movement relative to the basal member by threading the threaded member into and out of the basal member.

11. The invention of claim 10 wherein the holding member includes a socket component for receiving the near end of the mooring whip and the threaded member is threaded into the basal member with the stop face confronting the socket component.

12. The invention of claim 11 wherein the mooring angle is in a range of about 20° to about 30°.

13. The invention of claim 11 wherein the retracted angle is in a range of about 15° to about 20°.

14. The invention of claim 11 wherein the mooring angle is in a range of about 20° to about 30°, and the retracted angle is in a range of about 15° to about 20°.

15. The invention of claim 3 wherein the first positive stop includes a selectively adjustable first stop element for selective adjustment of the first position of the holding member and the second positive stop includes a selectively adjustable stop element for selective adjustment of the second position of the holding member.

16. A mooring whip mounting base for mounting a mooring whip to a docking structure with the mooring whip moveable selectively between a mooring position, wherein the mooring whip extends outwardly from the docking structure to bias a moored boat away from the docking structure, and a retracted position, wherein the mooring whip extends upwardly and inwardly relative to the mooring position of the mooring whip, the mooring whip having a near end adjacent the docking structure and a far end spaced away from the docking structure, the mooring whip mounting base comprising:

a basal member for affixation to the docking structure;

a holding member for holding the mooring whip at the near end of the mooring whip;

a connecting structure connecting the holding member with the basal member for selective movement of the holding member relative to the basal member between a first position wherein the mooring whip will extend outwardly from the docking structure at a mooring angle to a horizontal direction to be placed in the mooring position, and a second position wherein the mooring whip will extend upwardly at a retracted angle to a vertical direction, inward of the vertical direction, to be placed in the retracted position, the connecting structure comprising a pivotal coupling enabling essentially unbiased pivotal movement of the holding member between the first position and the second position; and a positive stop arrangement for limiting movement of the holding member to movement between the first position and the second position, the positive stop arrangement including a first positive stop for engagement upon movement of the holding member from the second position to the first position to preclude movement of the holding member beyond the first position, and a second positive stop for engagement upon movement of the holding member from the first position to the second position to preclude movement of the holding member beyond the second position, the first positive stop including a selectively adjustable stop element for selective adjustment of the first position of the holding member, the selectively adjustable stop element including a threaded member threaded into the holding member and having a stop face for movement relative to the holding member by threading the threaded member into and out of the holding member.

17. The invention of claim 16 wherein the holding member includes a socket component for receiving the near end of the mooring whip and the threaded member is threaded into the socket component with the stop face confronting the basal member.

18. A mooring whip mounting base for mounting a mooring whip to a docking structure with the mooring whip moveable selectively between a mooring position, wherein the mooring whip extends outwardly from the docking structure to bias a moored boat away from the docking structure, and a retracted position, wherein the mooring whip extends upwardly and inwardly relative to the mooring position of the mooring whip, the mooring whip having a near end adjacent the docking structure and a far end spaced away from the docking structure, the mooring whip mounting base comprising:

a basal member for affixation to the docking structure;

a holding member for holding the mooring whip at the near end of the mooring whip;

a connecting structure connecting the holding member with the basal member for selective movement of the holding member relative to the basal member between a first position wherein the mooring whip will extend outwardly from the docking structure at a mooring angle to a horizontal direction to be placed in the mooring position, and a second position wherein the mooring whip will extend upwardly at a retracted angle to a vertical direction, inward of the vertical direction, to be placed in the retracted position, the connecting structure comprising a pivotal coupling enabling essentially unbiased pivotal movement of the holding member between the first position and the second position; and a positive stop arrangement for limiting movement of the holding member to movement between the first position and the second position, the positive stop arrangement including a first positive stop for engagement upon movement of the holding member from the second position to the first position to preclude movement of the holding member beyond the first position, and a second positive stop for engagement upon movement of the holding member from the first position to the second position to preclude movement of the holding member beyond the second position, the first positive stop including a selectively adjustable first stop element for selective adjustment of the first position of the holding member and the second positive stop includes a selectively adjustable stop element for selective adjustment of the second position of the holding member, the first selectively adjustable stop element including a first threaded member threaded into the holding member and a first stop face for movement relative to the holding member by threading the first threaded member into and out of the holding member, and the second selectively adjustable stop element including a second threaded member threaded into the basal member and having a second stop face for movement relative to the basal member by threading the second threaded member into and out of the basal member.

19. The invention of claim 18 wherein the holding member includes a socket component for receiving the near end of the mooring whip, the first threaded member is threaded into the socket component with the first stop face confronting the basal member and the second threaded member is threaded into the basal member with the second stop face confronting the socket component.

20. The invention of claim 19 wherein the mooring angle is in a range of about 20° to about 30°.

21. The invention of claim 19 wherein the retracted angle is in a range of about 15° to about 20°.

22. The invention of claim 19 wherein the mooring angle is in a range of about 20° to about 30°, and the retracted angle is in a range of about 15° to about 20°.

* * * * *